356-400 SR
XR 3,985,356
TX 215/E

United States [1] 3,985,356
Carlock [45] Oct. 12, 1976

[54] APPARATUS FOR LOCATING AND POSITIONING A FOOTBALL ON A FOOTBALL PLAYING FIELD

[76] Inventor: Charles R. Carlock, 5611 Sir Gareth, San Antonio, Tex. 78218

[22] Filed: July 25, 1974

[21] Appl. No.: 491,769

[52] U.S. Cl. ..... 273/55 R; 33/289; 356/172

[51] Int. Cl.[2] ..... A63B 67/00

[58] Field of Search ..... 273/55 R, 101.1, 54 B; 33/158, 276, 289, 293, 294, 284, 287, 46; 73/308, 313, 314; 324/26; 340/323, 393, 394, 407; 350/222 R; 356/172

[56] References Cited

UNITED STATES PATENTS

| | | | |
|---|---|---|---|
| 2,308,814 | 1/1943 | Kenney et al. | 273/101.1 |
| 2,520,031 | 8/1950 | Darr | 33/289 |
| 3,462,845 | 8/1969 | Matthews | 33/186 UX |
| 3,502,333 | 3/1970 | Fleury | 273/101.1 |
| 3,608,199 | 9/1971 | Hunt | 33/289 |
| 3,633,285 | 1/1972 | Sensney | 273/101.1 |
| 3,741,662 | 6/1973 | Pioch | 356/172 |
| 3,752,588 | 8/1973 | Chapman | 33/289 X |
| 3,781,009 | 12/1973 | Gagnon | 273/55 B |

*Primary Examiner*—Richard C. Pinkham
*Assistant Examiner*—T. Brown
*Attorney, Agent, or Firm*—Fulbright & Jaworski

[57] ABSTRACT

A carriage is provided for movement along a track which is positioned parallel to one side of the playing field. Means for providing a measuring beam, such as a laser beam, is supported from the carriage and directs the measuring beam across the field and perpendicular to the track. A beam receptor which can be moved on the field is provided which includes means for detecting the measuring beam when the receptor is positioned in alignment with the beam and signaling means is connected to the detecting means for indicating when the receptor is positioned in alignment with the measuring beam whereby a football may be located or positioned on the field by its relative position to the receptor. Brake means are provided for releasably locking the carriage in place on the track. Measuring means may be connected to the carriage for moving the carriage predetermined distances along the track. The signaling means preferably includes both a visual signal and an audible signal.

10 Claims, 10 Drawing Figures

3985356

APPARATUS FOR LOCATING AND POSITIONING A FOOTBALL ON A FOOTBALL PLAYING FIELD

BACKGROUND OF THE INVENTION

Football games depend in many instances on the location and placement of a football within a distance of inches. For example, the football is spotted or located a number of times in a series of downs. Heretofore, the method by which the ball has been spotted or located has been for an official to mark or locate the ball with his foot, toss the ball to a hash mark, if necessary, and for the sideline official to place a marker corresponding with the nose of the football on one edge of the playing field. As has been obvious in the past, this method can be inaccurate. Because visual determinations are difficult and as the contour of the field tends to increase the difficulty of visual sightings, the proper placement and measurement of the football may be quite inaccurate.

The present invention is directed to an apparatus by which a football may be accurately located on a football field utilizing a measuring beam which is constantly perpendicular to the sideline of a playing field and which can be moved perpendicular to the sideline. A beam receptor is carried by an official on the field which provides a signal when the receptor is positioned in alignment with the beam whereby a football may be located or positioned on the field by its relative position to the receptor.

SUMMARY

The present apparatus is directed to locating, positioning, or measuring distances on a football field by providing a track positioned parallel to one side of the field which supports a movable carriage. The carriage carries means for providing a measuring beam and for directing the measuring beam across the field and perpendicular to the track thereby providing an accurate line of reference. A beam receptor is adapted to be carried about the field and includes means for detecting the measuring beam when the receptor is positioned in alignment with the perpendicular beam, and signaling means are connected to the detecting means for indicating when the receptor is positioned in alignment with the beam. When the ball is downed, an official may place the receptor on the nose of the football, and the carriage carrying the beam can be rolled on the track to the spot at which the beam intersects the receptor held by the official. The receptor may then be moved laterally across the field, such as to a hash mark, and located again within the perpendicular beam for properly locating the football. Furthermore, the beam will provide a reference point to which the ball may be returned after an incomplete pass or provide an accurate reference line from which to measure penalities.

Yet a still further object of the present invention is the provision of brake means for releasably locking the carriage in place on the track to insure that the measuring beam is not inadvertently moved between measurements.

Still a further object of the present invention is the provision of measuring means connected to the carriage for measuring the distance the carriage moves along the track whereby first downs may be accurately measured and/or penalties may be accurately assessed.

Still a further object of the present invention is the provision in which the signaling means includes preferably both a visual signal, which may be observed by the spectators as well as the officials and an audible signal to instill confidence in the method of location and measurement of the football.

Yet a still further object of the present invention is te provision of a measuring beam which provides a distinctive signal and means for detecting the measuring means which includes decoding means responsive only to the distinctive measuring beam whereby the detecting and signaling means will not be activated by extraneous environmental conditions such as light, sound and other electromagnetic signals present.

Still a further object of the present invention is the provision of a protective plastic shield connected to the track on the side adjacent the field for protecting the apparatus and players in the event of a collision of players with the apparatus.

Other and further features and advantages will be readily apparent from the following description of the preferred embodiment.

DESCRIPTION OF THE PREFERRED EMBODIMENT

Figure 1:
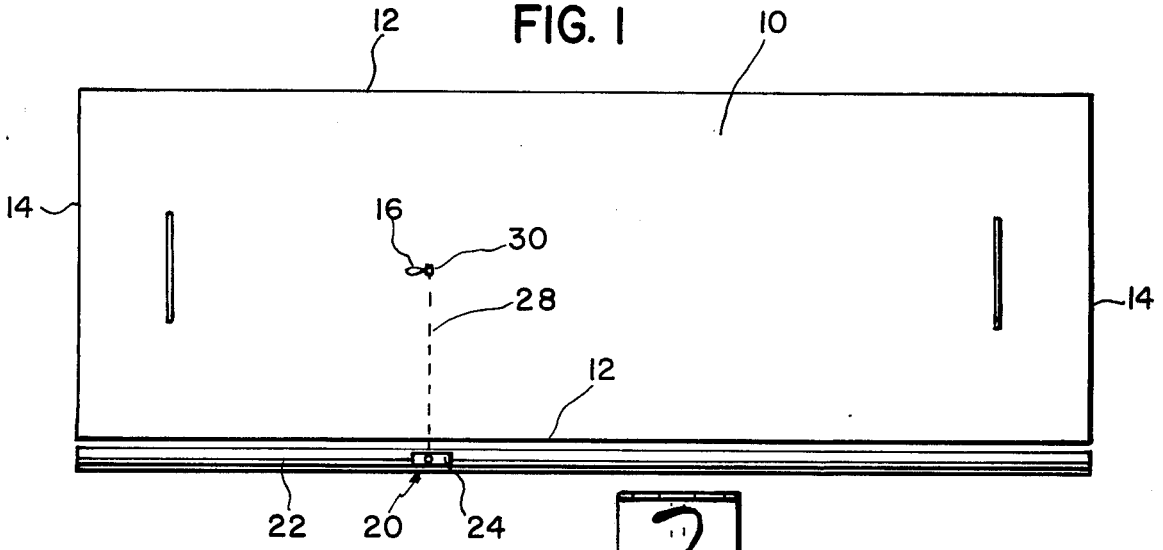
FIG. 1 is a plan view of a football playing field illustrating the use of the apparatus of the present invention.

Referring now to the drawings, and particularly to FIG. 1, the reference numeral 10 generally indicates a conventional football playing field having the usual sides 12 and ends 14. The present invention is directed to locating, positioning, and measuring the position of a conventional football 16 on the field 10. The apparatus generally indicated by the reference numeral 20 includes a track 22 positioned parallel to one side 12 of the playing field 10, a carriage 24 movable along the track 22, and means carried by the carriage 24 and generally indicated by the reference numeral 26 (FIG. 2) for providing a measuring beam and directing the beam 28 across the field 10 and perpendicular to the track 22, and a beam receptor 30 for detecting the measuring beam when the receptor 30 is positioned in alignment with the beam 28.

Figure 2:
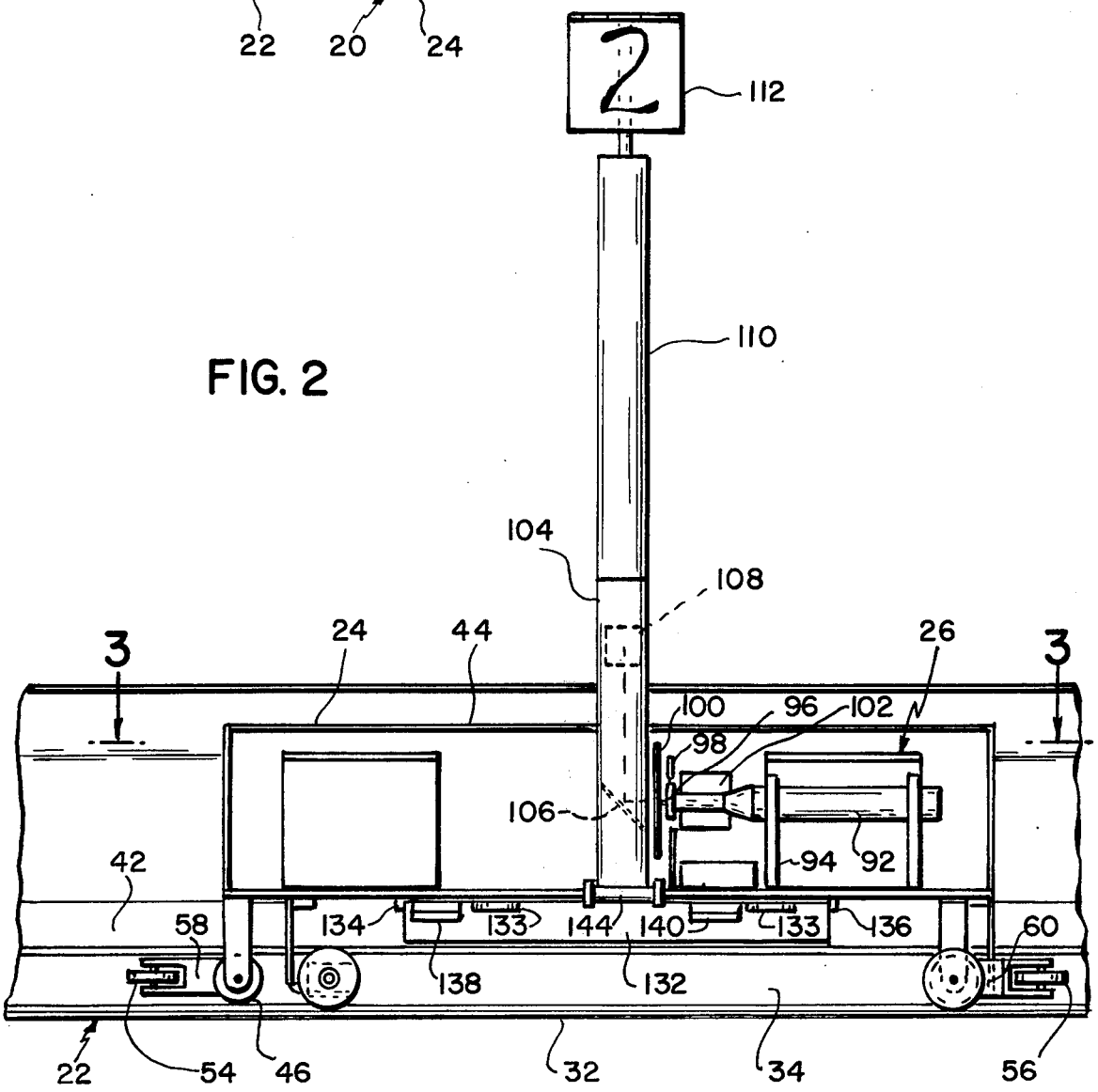
FIG. 2 is an enlarged elevational view, partly in cross section, of the carriage and track of the present invention.
Figure 6:
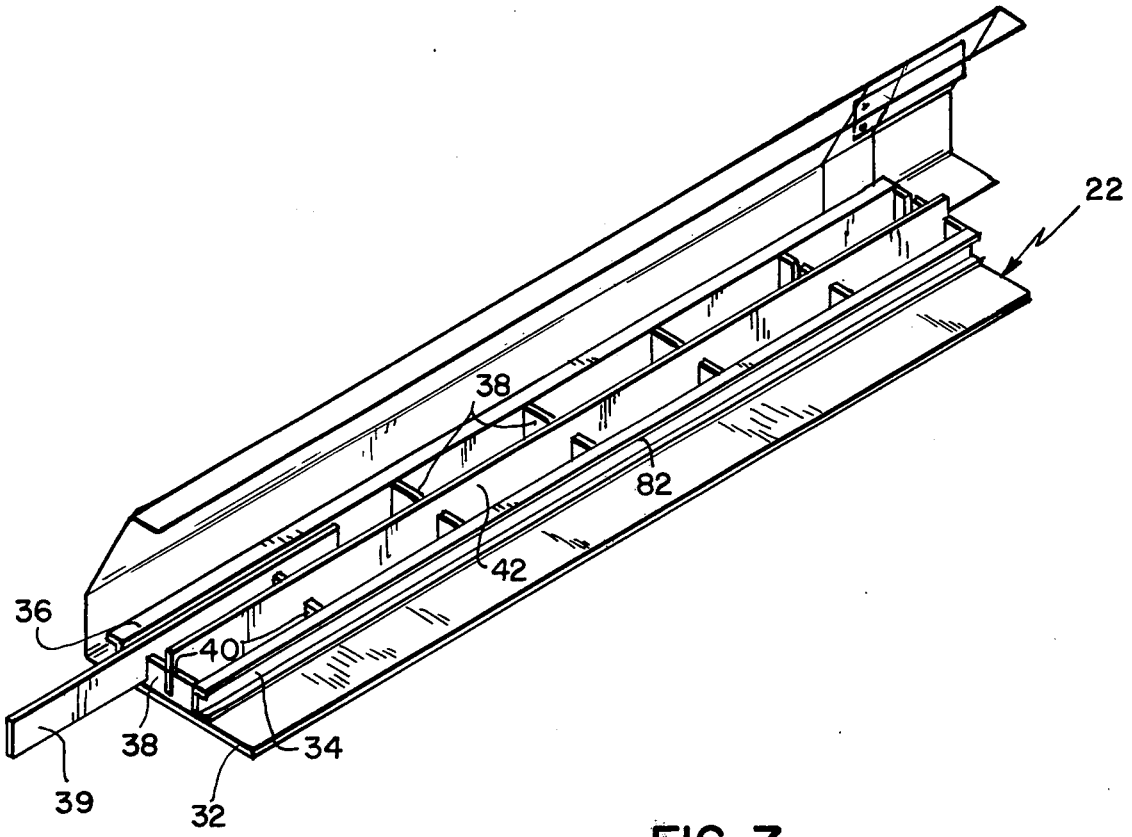
FIG. 6 is an enlarged isometric view of a portion of the track.

While various types of tracks may be used to support the carriage 24, the preferable track, as best seen in FIGS. 2 and 6, includes a base plate 32 on which are mounted oppositely facing channels 34 and 36 which form tracks for receiving the wheels of the carriage 24, as will be more fully described hereinafter. The tracks 34 and 36 are separated by a plurality of spacer bars 38 which are precisely milled for giving a uniform distance between the tracks 34 and 36. A slot 40 is provided in each spacer bar 38, which is also precisely milled, in which is positioned a stationary alignment bar 42. The alignment bar 42, as will be more fully described hereinafter, may be used to accurately align the measuring beam perpendicular to the track 22. Generally, the track 22 will be located approximately six feet from a side 12 of a football field 10. The track 22 is preferably made up of twelve foot sections and the base 32 may be suitably perforated to allow metal pins to be driven through the perforations to anchor the track in place along the side of the field 10. The sections of track 22 are further interconnected by a connecting bar 39 which is connected to several spacer bars 38 of each section.

Referring now to FIGS. 1, 2, 3 and 4, the carriage 24 is best seen which includes a housing 44 and is supported by a plurality of wheels 46, 48, 50 and 52. Wheels 46 and 48 travel in channel 34 and wheels 50 and 52 travel in channel 36 for rollingly supporting the carriage 24 as it moves along the track 22. In addition, if desired, horizontally disposed wheels 54 and 56 are connected to the housing 44 by spring supports 58 and 60, respectively, which act to maintain the housing 44 in a horizontal plane relative to the track 22 thereby assisting in maintaining the carriage 24 in a parallel relationship to the track 22. If desired, one or more distance measuring means 62 and 64 may be connected to the carriage 24 for measuring the longitudinal distance that the carriage 24 moves along the track 22. The distance measuring means may be of the type sold under the trade name Measure Master by Rolatape Corporation of Santa Monica, California, Model MM 45 which measures feet and inches and are connected to measuring wheels 66 and 68, respectively, which ride on the base 32 of the track 22. The distance measuring means 62 and 64 are useful in making an accurate determination when a first down has been achieved and are also useful for measuring the yardage assessed in penalties.

Figure 4:
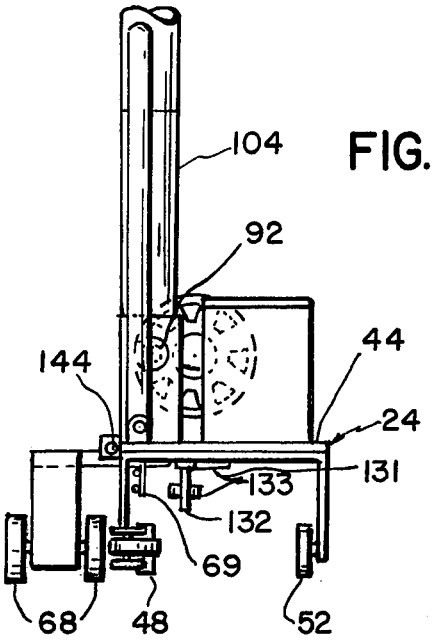
FIG. 4 is a cross section taken along the line 4—4 of FIG. 3.
Figure 10:
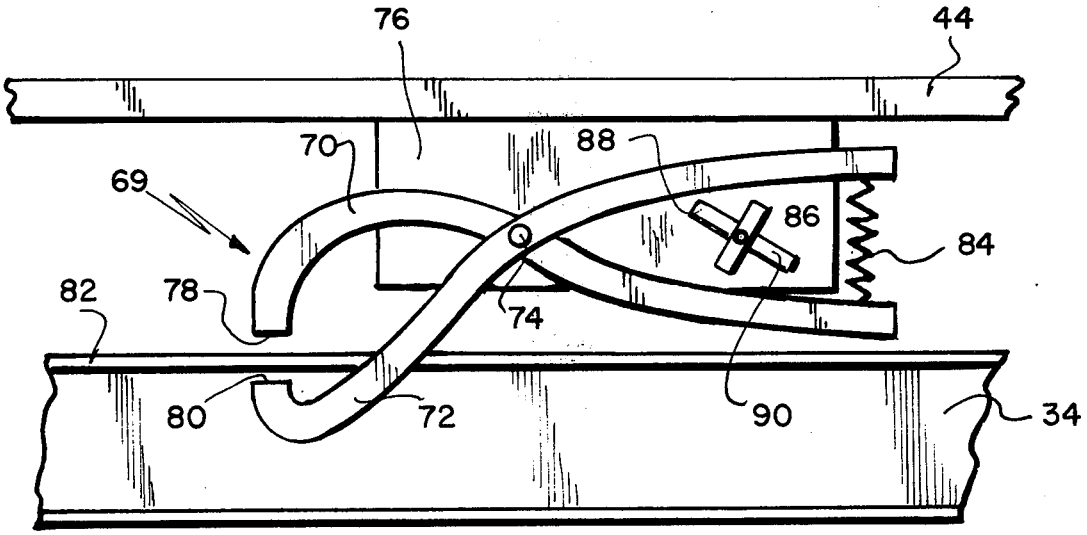
FIG. 10 is an enlarged elevational view of the brake.

Referring now to FIGS. 4 and 10, brake means generally indicated by the reference numeral 69 may be provided on the carriage 24 for releasably locking the carriage in place on the track for maintaining a position of measurement of the measuring beam 28. For example, a pair of tongs 70 and 72 are connected at a pivot point 74 to a plate 76 connected to the housing 44 of the carriage 24. The tongs 70 and 72 include ends 78 and 80 which are positioned to engage and grip the upper flange 82 of channel 34. A spring 84 is provided which normally pulls the free ends of the tongs 70 and 72 together to cause the ends 78 and 80 to engage the flange 82 for locking the carriage in place. A lever 86 is provided pivotally connected to the plate 76 and having pins 88 and 90. When the lever 86 is rotated to a horizontal position, the pins 88 and 90 engage the free ends of the tongs 72 and 70, respectively, to move them apart and disengage the ends 78 and 80 from the flange 82. And when it is desired to actuate the brake, the lever 86 is rotated out of the horizontal position so that the pins 88 and 90 become disengaged from the free ends of the tongs 70 and 72 allowing the spring 84 to actuate the brake. Therefore, the carriage can be moved to a desired position to take a sighting on the football 16 and locked in place and after the next down may be again disengaged from the track 22 and moved to the next location.

Figure 3:
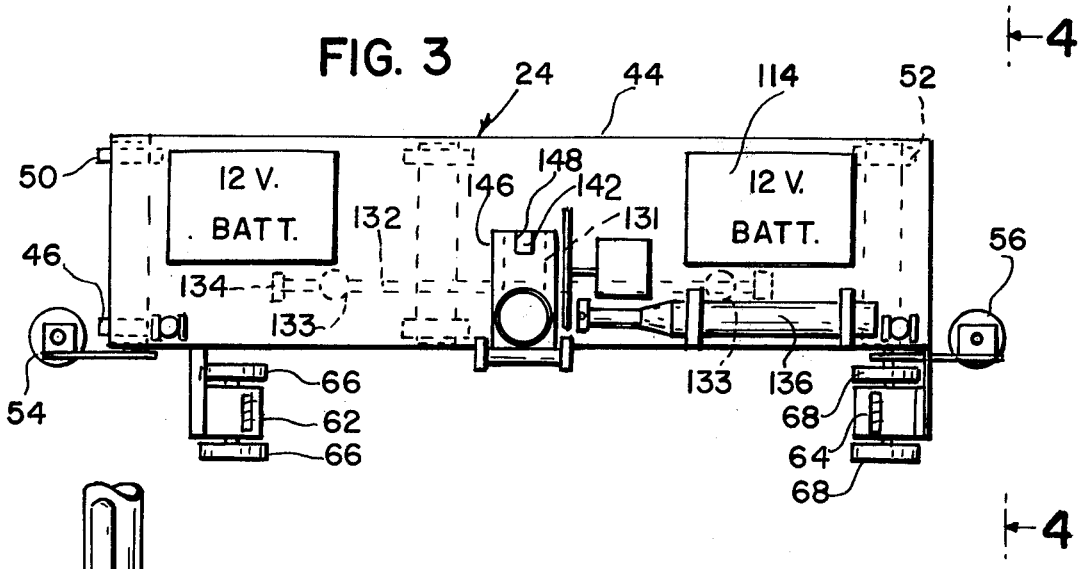
FIG. 3 is a cross-sectional view taken along the line 3—3 of FIG. 2.

Referring now to FIGS. 2 and 3, suitable means are carried by the carriage 24 for providing the measuring beam 28 and directing the measuring beam 28 across the field and perpendicular to the track 22. Any suitable type of electromagnetic wave source may be provided for providing a narrowly directed measuring beam. Preferably, the means 92 for providing the measuring beam is a laser beam, such as sold by the Micro-Grade Laser Company of Palo Alto, California. The laser 92 is carried by the carriage 22 by a suitable support 94. Since the laser 92 may be continuously actuated, a shutter 96 which normally closes the outlet of the laser 92 is controlled by a solenoid 98 for opening the shutter when the apparatus is in use. It is desirable that the laser 92 provide a unique signal which can be detected by the receptor 30 but one that can only be recognized by the receptor 30 so that the receptor will not be subjected to accidental actuation by the presence of extraneous electromagnetic waves on the field such as light and electronic equipment in the vicinity of the playing field 10. For example, the laser beam may be modulated or pulsed by means of a rotating disc 100 which is driven by a motor 102 to provide a pulsating 620 HZ signal. Generally, it is desired to keep the carriage 24 with a low profile, but since the playing field is usually curved upwardly towards the center, it may be desirable to raise the vertical level of the projecting perpendicular beam 28. Thus, a beam directing housing 104 is provided. The housing 104 may include a first mirror 106 in the path of the laser 92 for directing the beam vertically. A second mirror 108 then projects the laser beam 28 across the field of play. The housing 104, may, if desired, include an extension 110 which will support a conventional down marker 112.

Figure 5:
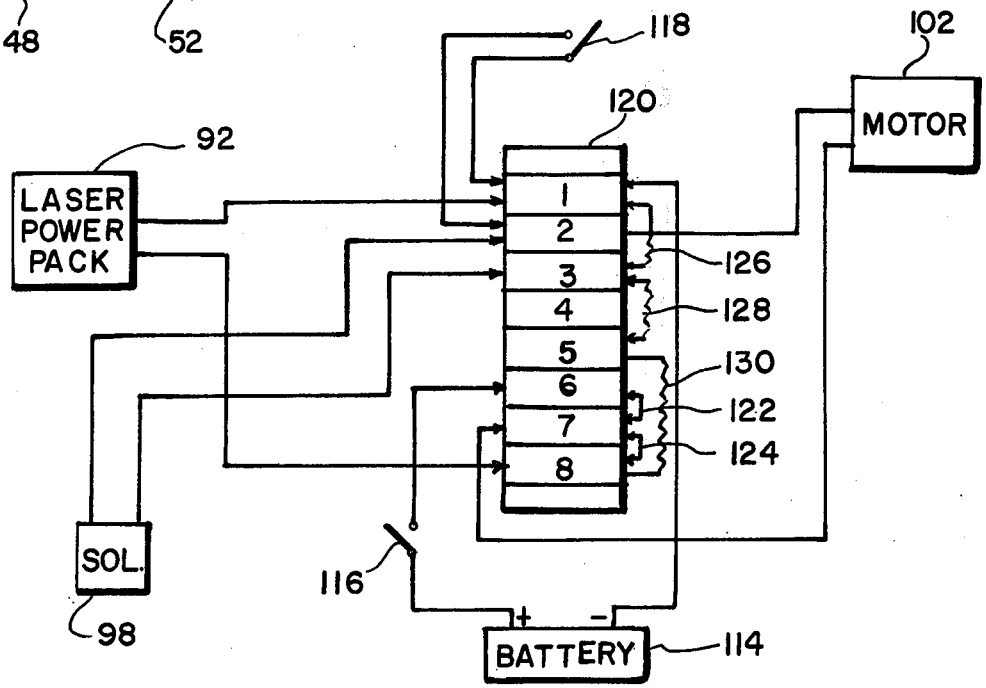
FIG. 5 is an electric schematic of the electrical system on the carriage for providing the measuring beam.

Referring now to FIG. 5, an electrical schematic is shown for the operation of the laser 92. A suitable power source such as a battery 114 is provided. A main switch 116 and an operating switch 118 are provided connected to a conventional terminal board 120. When the switch 116 is closed, power is supplied from the battery to terminal No. 6 and by jumper connections to terminal No. 8 to turn on laser 92. When it is desired to actuate the apparatus, switch 118 is closed, battery power is supplied through switch 116 and terminal 6 and 7 to one side of the disc motor 102 and the second side of the battery is connected to terminal 1 whereby the closed switch 118 supplies power to actuate the solenoid 98 to open the shutter 96 and supply power through terminal 2 to the second side of the motor 102 to operate the disc 100 to supply the distinct measuring beam 28. Resistors 126, 128 and 130 are provided across the terminal board 120 to reduce power when maximum current is not required.

Figure 9:
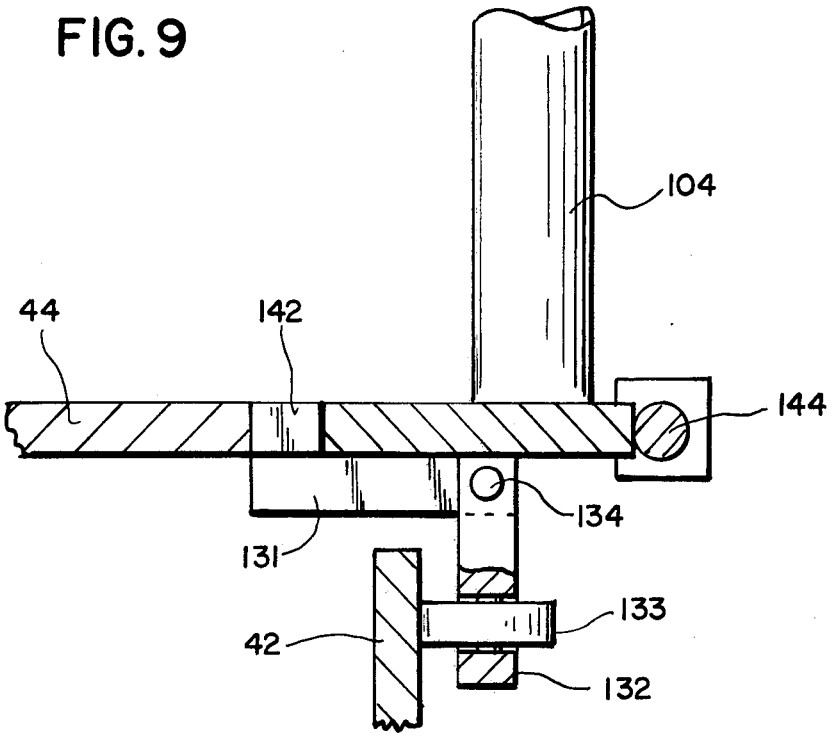
FIG. 9 is an enlarged elevational view of the connection for aligning the measuring beam.

While generally, the carriage 24 is aligned on the track 22 and may be used for directing the beam 28 perpendicular to the track 22, it is preferable as has been indicated, to utilize the stationary alignment bar 42 (FIGS. 2, 6 and 9) to give a parallel line to the side 12 of the field 10 for directing the measuring beam 28. The carriage 24 includes a traveling alignment bar 132 (FIGS. 2, 3, 4 and 9) which is loosely connected to the housing 44 by end supports 134 and 136 such as a pin and slot connection (not shown) which allow a limited amount of lateral movement of the traveling alignment bar 132 relative to the carriage 44. In addition, one or more spring-loaded hinges 138 and 140, such as conventional spring-loaded door hinges, have one edge secured to either the traveling bar 132 or the frame 44 of the carriage 24. Thus, the traveling alignment bar 132 is continuously urged into engagement against the stationary traveling bar 42 and therefore, the traveling alignment bar 132 maintains a parallel line of travel to the edge 12 of the playing field 10 as the carriage 24 is moved along the track 22. Preferably, the alignment bar 132 includes one or more wheels 133 (FIGS. 2, 3, 4 and 9) which engage and travel along the side of stationary alignment bar 42 for reducing friction between bars 132 and 42. As best seen in FIGS. 3 and 9, an upwardly protruding tongue 142 is connected to the traveling alignment bar 132 in a perpendicular plane to the traveling bar 132 by plate 131 (FIGS. 3, 4 and 9) and therefore provides the perpendicular direction for directing the beam 28. Referring to FIGS. 2, 3 and 9, it is noted that the directing housing 104 is connected to the frame 44 of the carriage 22 through a pin 144 which is loosely connected to the frame 44 for allowing a limited amount of play. The directing housing 104 includes a base 146 which includes a slot 148 which fits precisely with the tongue 142. Since the traveling bar 132 controls the movement of the tongue 142 for keeping the tongue 142 in a perpendicular alignment with the stationary bar 42, the tongue 142 in turn will keep the base 146 in perpendicular alignment thereby insuring that the beam 28 is projected perpendicularly across the field. That is, when the slot 148 is fitted over the upstanding tongue 142, the directing housing 104 which reflects the laser beam 28 across the field 10 is constantly on a perpendicular angle to the traveling alignment bar 132 and the fixed alignment bar 142 which are parallel to the field of play. This assures that the laser beam 28 itself is constantly perpendicular to the field of play 10.

Figure 7:
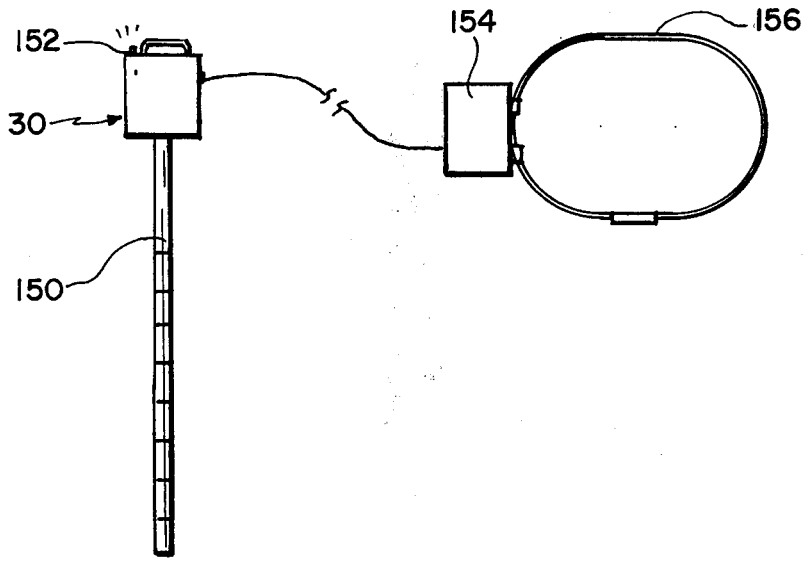
FIG. 7 is an elevational view of the receptor of the present invention for detecting the location of the perpendicular measuring beam.

Referring now to FIG. 7, the receptor 30 is used in conjunction with the laser beam 28 as it is projected across the field 10 from the carriage 24 and includes means for detecting the measuring beam 28 when the receptor 30 is positioned in alignment with the beam 28. The receptor 30 includes an elongate rod 150 which comprises a string or an array of a plurality of light sensitive silicon photo diodes which form a wand or rod, for example 20 inches in length, which may be moved in the general area of the laser beam 28 and detects its presence. The diodes are connected to an electronic circuit which detects the laser beam 28 as it is projected, recognizes its strength, and rate of pulsation and signals the presence of the alignment of the receptor 30 in the beam 28 to a detecting apparatus which actuates a suitable signaling means such as a buzzer to provide an audible signal that the receptor is aligned and also an xenon flashbulb 152 which blinks rapidly and brilliantly when the receptor array 150 intersects the path of the laser beam 28. The receptor 30 is carried by one of the officials and includes its own power source 154 which may be secured by a belt 156 to the waist of the official.

Figure 8:
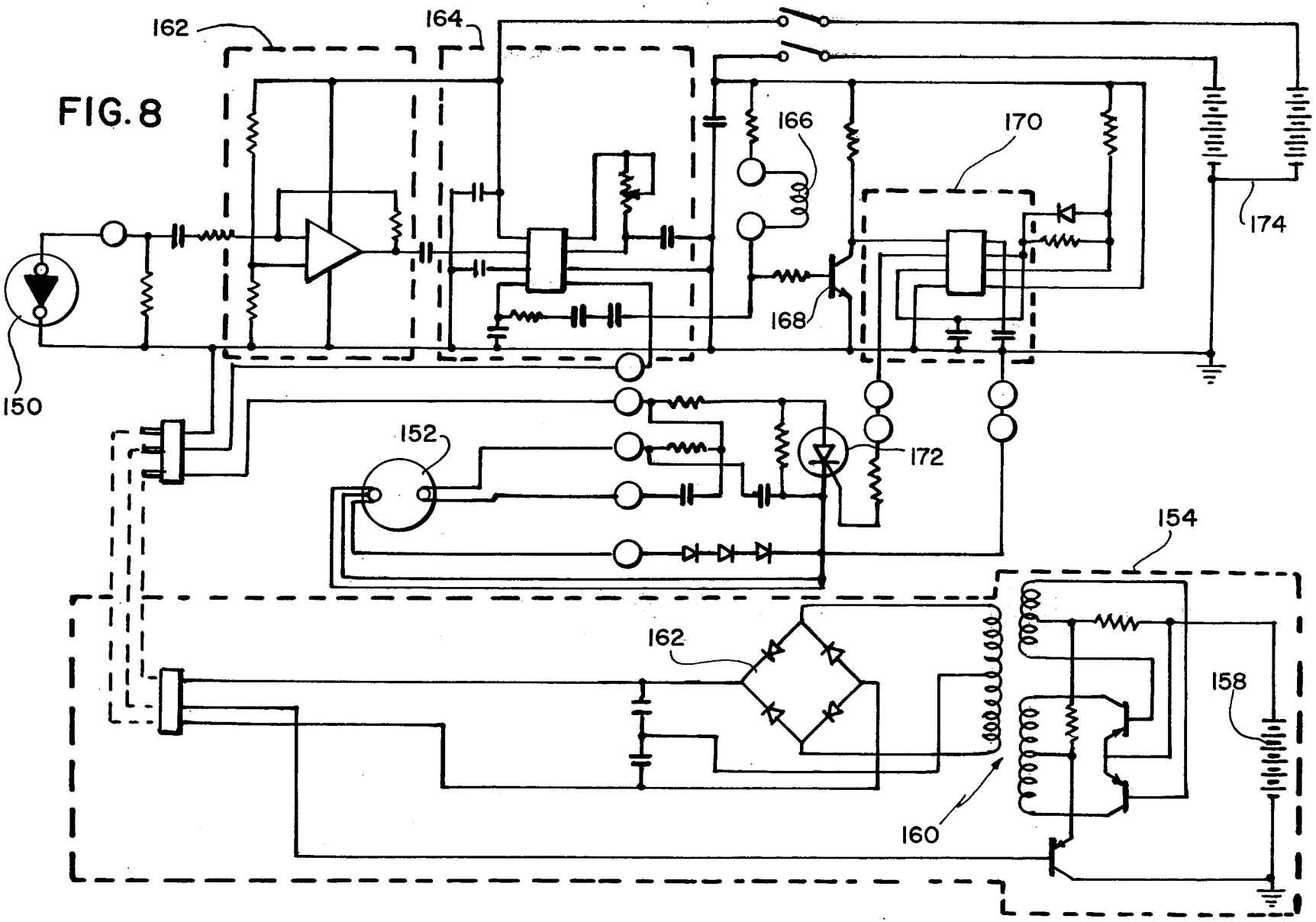
FIG. 8 is an electrical schematic of the electrical detecting circuit of the receptor of FIG. 7.

Referring now to FIG. 8, the electrical circuit of the receptor 30 is best seen for detecting and recognizing a laser beam, which may be of approximately ⅝ inches in diameter and is chopper modulated at 620 HZ rate. The power source 154 may include a battery source 158 feeding a converter transformer 160 and a rectifier 162 for providing power to the receptor 30 for providing the high voltage power supply for the strobe light 152. As previously mentioned, the receptor 30 includes a plurality of silicon photo diodes in an array 150, only one of which is shown in FIG. 8, which detects the laser beam. The array 150 is connected in parallel and is capacitively coupled to a conventional operation amplifier 162 such as Model 741 as sold by Singetics, Inc. The output from the operational amplifier 162 is fed to a decoder 164 which is adjusted to detect the 620 HZ laser beam signal and ignore any other extraneous light or electromagnetic signals in the vicinity. The decoder 164 may include Model No. XR567 decoder as sold by the Exar Integrated Systems, Inc. The output from the decoder 164 is used to activate a buzzer 166 and the high voltage power supply 154. The output from the decoder is also fed through an inverter 168 to control the strobe timer 170 which may be Model No. NE555 strobe as sold by Singetics, Inc. The strobe timer, when actuated, produces approximately five pulses per second. The output from the strobe timer 170 is used to gate a silicon control rectifier 172 which applies the trigger voltage to the strobe light 152. The detector 150, buzzer 162 and strobe timer circuit 170 are powered by battery 174.

In use, when the football is downed, the official carrying the receptor 30 will place the receptor 30 on the nose of the football at the point at which the ball has been downed. The carriage 24 carrying the activated measuring beam 28 will be rolled along the track 22 to the spot at which the beam 28 intersects the receptor 30 held by the official. At that point, the carriage 24 may be locked in place by the brake mechanism 69 shown in FIG. 9 and the beam 28 will be directed across the field to give a perpendicular data line for the football's proper location. If it is necessary to move the ball to a hash mark, the receptor 30 may then be moved to the hash mark and moved longitudinally along the field until it intersects the beam 28 at which point the football may be placed down on the hash mark with its nose against the receptor 30. This sequence of operation may be repeated after each down and in the event of an incomplete pass, and the beam 28 will provide an accurate reference for placing the football to its correct position. The carriage 24 is released from the track 22 and moved after each down to the next position of the ball and the distance measuring means 62 and 64 may be utilized to note the movement of the carriage ten yards to determine whether or not a first down has been made. Furthermore, by the use of the distance measuring means 62 and 64, accurate penalty measurements can be used to place the football in the proper position.

The present invention, therefore, is well adapted to carry out the objects and attain the ends and advantages mentioned as well as others inherent therein. While a presently preferred embodiment of the invention is given for the purpose of disclosure, numerous changes in the details of construction and arrangement of parts will readily suggest themselves to those skilled in the art and which are encompassed within the spirit of the invention and the scope of the appended claims.

What is claimed is:

1. An apparatus for locating the position of a football on a football playing field comprising, a track positioned parallel to one side of and spaced from the playing field, a carriage having a plurality of wheels engaging said track and supporting said carriage, beam directing means for producing a measuring beam loosely carried by said carriage for directing said beam across said field and perpendicular to said track, said track including a stationary alignment bar, said stationary alignment bar being positioned near said track and parallel thereto;

a traveling alignment bar perpendicularly connected to said beam directing means and movably carried by said carriage along said stationary alignment bar, means mounted on said traveling alignment bar and engaging said stationary alignment bar for maintaining said traveling alignment bar in parallel alignment with said stationary bar, a beam receptor adapted to be moved unrestricted over said field and including means for detecting said beam when said receptor is positioned in alignment with said beam, and signaling means connected to said detecting means for indicating when the receptor is positioned in alignment with the measuring beams whereby a football may be located or positioned on the field by its relative position to said receptor.

2. The apparatus of claim 1 wherein the carriage includes, means connected to the carriage for releasably locking the carriage in place on the track.

3. The apparatus of claim 1 wherein the carriage includes, means for measuring the distance the carriage moves along the track.

4. The apparatus of claim 1 wherein the signaling means includes, a visual signal.

5. The apparatus of claim 4 wherein the signaling means includes, an audible signal.

6. The apparatus of claim 1 wherein the means for detecting the measuring beam includes, decoding means responsive only to the measuring beam whereby the signaling means will not be activated by extraneous environmental conditions.

7. The apparatus of claim 1 wherein the means for providing a measuring beam includes, a coded electromagnetic wave.

8. The apparatus of claim 7 wherein the means for providing the measuring beam includes a laser.

9. The apparatus of claim 1 wherein said beam receptor is an elongate rod having a plurality of vertically positioned detector elements attached thereto.

10. The apparatus of claim 1 wherein the signaling means includes an audible signal.

* * * * *

UNITED STATES PATENT OFFICE
CERTIFICATE OF CORRECTION

PATENT NO. : 3,985,356

DATED : October 12, 1976

INVENTOR(S) : Charles R. Carlock

It is certified that error appears in the above-identified patent and that said Letters Patent are hereby corrected as shown below:

Column 7, line 25, delete "connected to the carriage"
Column 8, line 3, after "means" insert -- connected to the carriage --

Signed and Sealed this

First Day of February 1977

[SEAL]

*Attest:*

RUTH C. MASON
*Attesting Officer*

C. MARSHALL DANN
*Commissioner of Patents and Trademarks*